US007195493B1

(12) United States Patent
Polnyi

(10) Patent No.: US 7,195,493 B1
(45) Date of Patent: Mar. 27, 2007

(54) LAND GRID ARRAY SOCKET CONNECTOR WITH LOCATION MEMBERS

(75) Inventor: Igor Polnyi, Aurora, IL (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/481,161

(22) Filed: Jul. 3, 2006

(51) Int. Cl.
*H01R 12/00* (2006.01)

(52) U.S. Cl. ..... 439/70

(58) Field of Classification Search ..... 439/526, 439/70, 71

See application file for complete search history.

(56) References Cited

U.S. PATENT DOCUMENTS 4,652,973 A * 3/1987 Baker et al. ..... 361/739
4,655,519 A * 4/1987 Evans et al. ..... 439/74
5,009,608 A * 4/1991 Shipe ..... 439/331
5,022,869 A * 6/1991 Walker ..... 439/526
5,032,088 A * 7/1991 Kuramitsu ..... 439/378
5,226,825 A * 7/1993 Ricci et al. ..... 439/70
5,410,258 A * 4/1995 Bowers et al. ..... 324/755
5,885,101 A * 3/1999 Matsuoka et al. ..... 439/526
6,325,638 B1 * 12/2001 Chapin et al. ..... 439/73
6,559,665 B1 * 5/2003 Barabi ..... 324/755
6,679,707 B1 1/2004 Brodsky et al.
6,692,280 B2 * 2/2004 Renfro et al. ..... 439/342
6,755,668 B2 * 6/2004 Copper et al. ..... 439/83
2006/0033518 A1 * 2/2006 LaMeres et al. ..... 324/758

* cited by examiner

*Primary Examiner*—Tulsidas C. Patel
*Assistant Examiner*—Phuongchi Nguyen
(74) *Attorney, Agent, or Firm*—Wei Te Chung

(57) ABSTRACT

A land grid array (LGA) socket connector (10) includes a number of contact segments (120, 140, 160, 180) and location members (122, 142, 162, 182). The contact segments are combined to form a substantially rectangular contact region. The location members are physically separated from one another, and further disposed around the respective corners of the combined contact regions to receive and hold an IC package (2) in position.

10 Claims, 10 Drawing Sheets

LAND GRID ARRAY SOCKET CONNECTOR WITH LOCATION MEMBERS

BACKGROUND OF THE INVENTION

1. Field of the Invention

The present invention relates to the art of electrical connectors, and more particularly to a land grid array (LGA) socket connector having separate location members for holding electronic components, such as an LGA package and/or another connector in position.

2. General Background

Land grid array (LGA) packages are becoming one of the popular chip packages in the interconnect market. As input/output (I/O) requirements of the chip package have increased, the LGA package needs to be larger in volume, where it can provide a high quantity of interconnecting contacts for signal transmission to a printed circuit board (PCB). In order to enable an effective and reliable attachment between the LGA packages and the PCBs, various LGA connectors have been developed.

However, with the increasingly large LGA packages, these conventional LGA connectors have many disadvantages. For example, these conventional LGA connectors are designed to be very complex, and thus may occupy much more valuable "real estate" on the supporting printed circuit board, which is undesirable in pursuit of miniaturization of electronic components. Further, these LGA connectors are typically directed to specific LGA packages. That is, one LGA connector is merely applicable to certain types of LGA packages having uniform sizes, and there is no flexibility of the LGA connector for application to another LGA packages with varying sizes. This will increase additional cost of manufacturing electronic components, which involves the application of the LGA connectors.

On the other hand, attempts in forming the large LGA connectors for mating with the increased popularity of LGA packages have been always met with difficulties resulting from material flow and shrinkages problems that were magnified as the contact receiving array formed on the LGA connect became larger. Therefore, if the LGA connector were formed from a multiple smaller sections, some of these problems may be solved.

SUMMARY OF THE INVENTION

A land grid array (LGA) socket connector according to an embodiment of the present invention include a plurality of contact segments, and location members. The contact segments are adapted for engaging respective connection sections of an IC package. The contact segments are combined to form a substantially rectangular contact region. The rectangular contact regions define corners. The location members are physically separated from one another, and further disposed around the respective corners of the combined rectangular contact regions to receive and hold the IC package in position. Compared with the prior art, such a LGA socket connector is designed to be structurally versatile, and will certainly occupy less room on the supporting printed circuit board. Further, there are no difficulties, including the material flow and shrinkage problems, existing for manufacturing the LGA socket connector, due to having several separate pieces, such as contact segments and location members, combined to form the LGA socket connector.

Other features and advantages of the present invention will become more apparent to those skilled in the art upon examination of the following drawings and detailed description of preferred embodiments, in which:

DETAILED DESCRIPTION OF PREFERRED EMBODIMENTS

Figure 1:
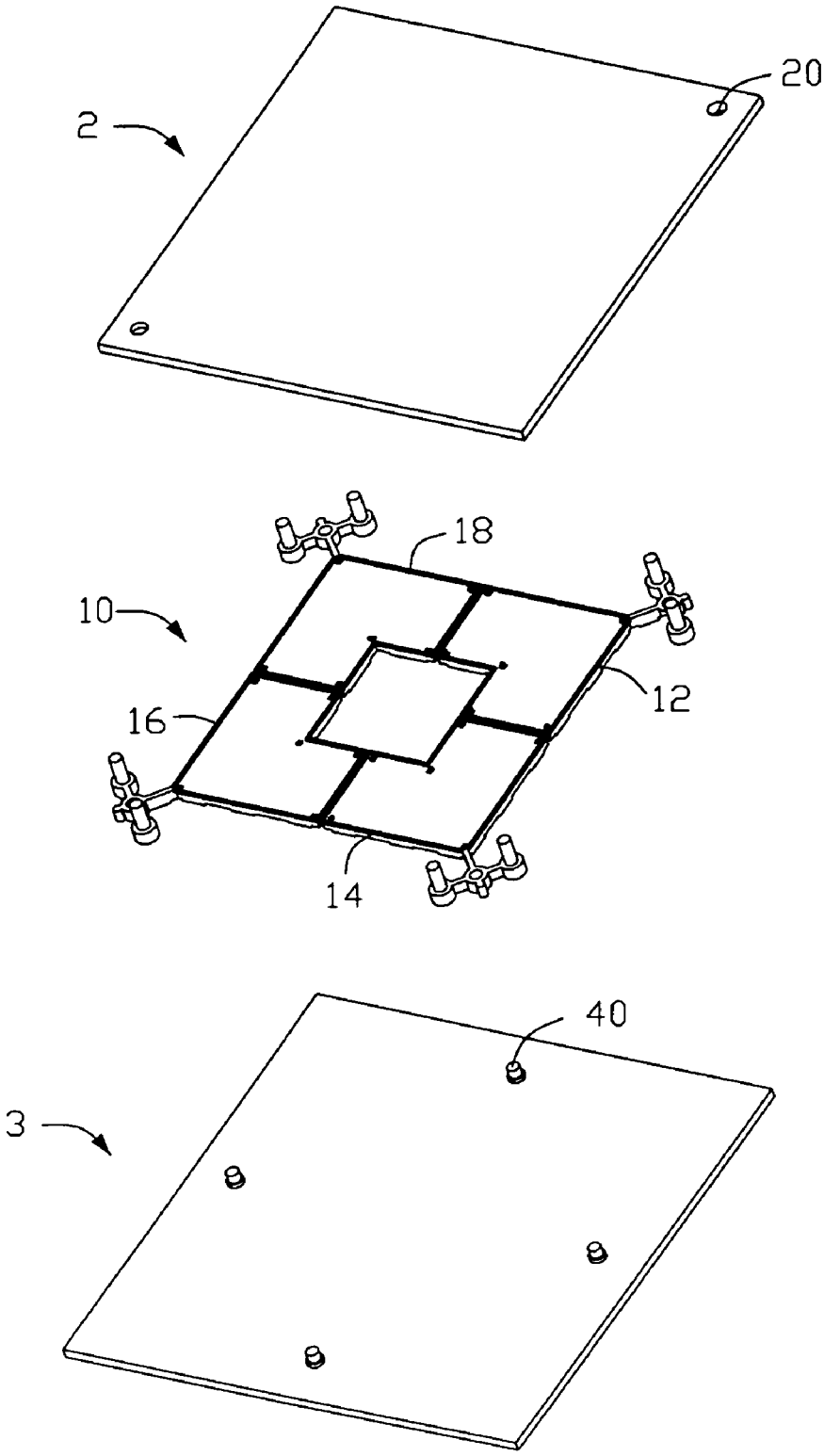
FIG. 1 is an exploded, perspective view of a land grid array (LGA) socket connector according to a first embodiment of the present invention.

Referring to FIGS. 1 to 6, a first LGA socket connector 10 for electrically connecting an IC package 2 and a printed circuit board 3 is shown according to the first embodiment of the present invention. The LGA socket connector 10 includes four separate LGA connector sections 12, 14, 16 and 18, and four supporting tabs 40.

Each of the LGA connector sections includes a contact region and a location member integrally attached to a corner of the contact region. Specifically, the LGA section 12 has a first contact segment 120 with a first location member 122 attached to its corner 10A. The LGA section 14 has a second contact segment 140 with a second location member 142 attached to its corner 10B. The LGA section 16 has a third contact segment 160 with a second location member 162 attached to its corner 10C. The LGA section 18 has a fourth contact segment 180 with a fourth location member 182 attached to its corner 10D.

The contact segments 120, 140, 160 and 180 are combined to form a substantially rectangular contact region or socket body for engaging an array of conductive elements of the IC package 2, which is just placed on the rectangular contact region. In this embodiment, a substantially rectangular through hole 19 is formed in the central section of the contact region. However, in some embodiments, there is no central through hole formed. It should be noted that the rectangular socket body might include any other suitable number of contact segments while still having location members 122, 142, 162, and 182 attached to the respective corners 10A, 10B, 10C and 10D of the combined socket body.

In this embodiment, these location members 122, 142, 162, and 182 are physically separated from one another, and further located around the respective corners 10A, 10B, 10C and 10D of the combined contact region so as to commonly receive and hold the IC package 2 in position. However, in other alternative embodiments, the location members 122, 142, 162, and 182 may be located around at least two corners, such as corners disposed diagonally with respect to a diagonal line of the combined contact region, as long as the location members 122, 142, 162, and 182 can effectively receive and hold the IC package 2 in position.

Figure 3:
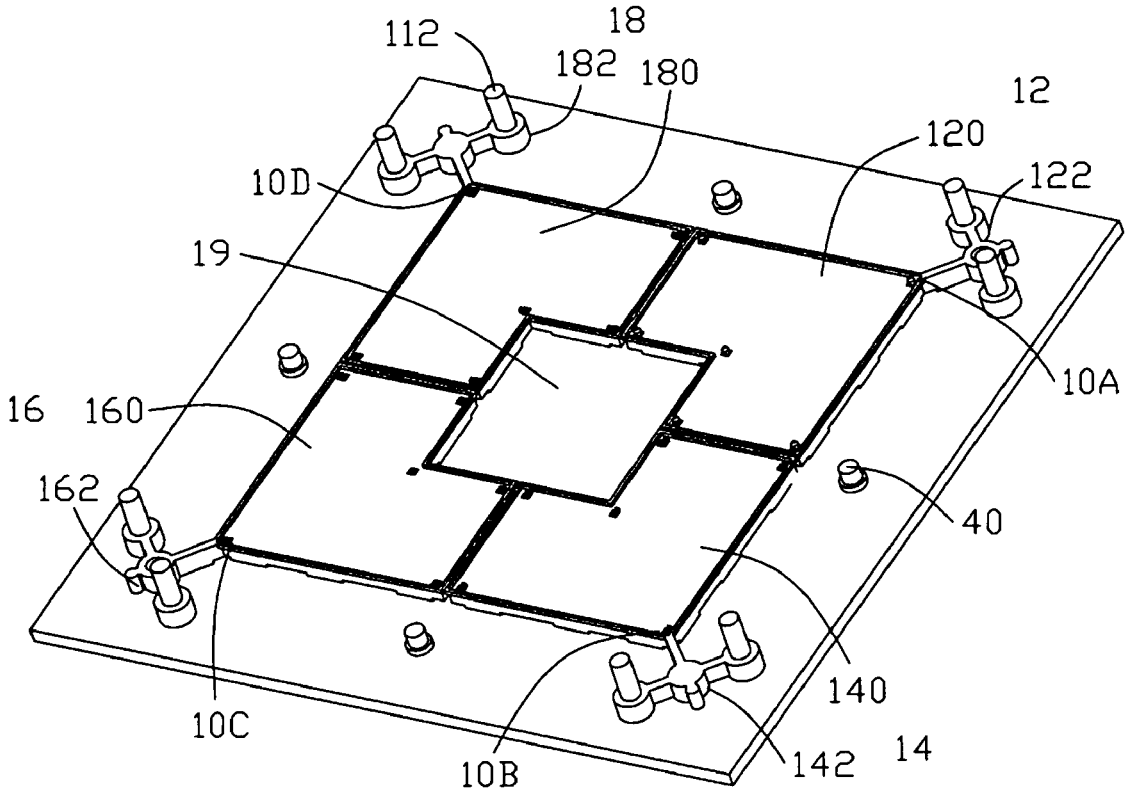
FIG. 3 is an assembled, perspective view of the LGA socket connector of FIG. 1, but with the IC package removed therefrom.
Figure 6:
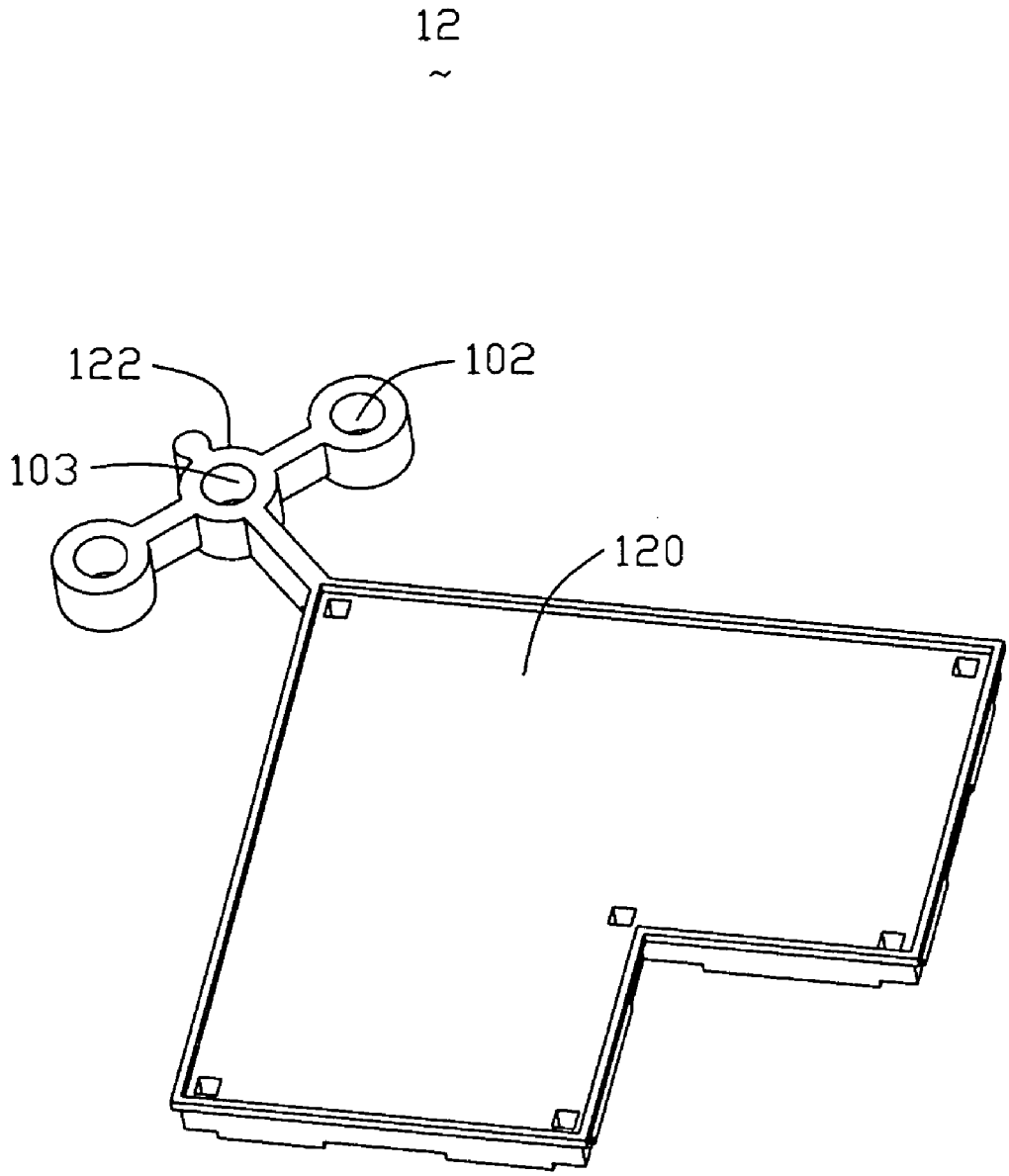
FIG. 6 is a perspective view of a LGA connector section of the LGA socket connector of FIG. 1.

Referring also to FIGS. 3 and 6, each of the location members includes a pair of locating holes 102, and a pair of locating elements 112, such as having a post shape with a predetermined height, for being received within the corresponding locating holes 102. These locating holes 102 are disposed along respective lengthwise sides and lateral sides of the combined contact region, such that when the locating posts 112 are inserted into the respective locating holes 102, the inserted locating posts 112 are employed to engage an outer periphery edge of one electronic component, such as the single IC package 2; or to engage more electronic components, such as the single IC package 2 and another electrical connector (not shown) required to be placed on the IC package 2. Specially, each pair of locating posts 112 is located around the corresponding contact segment corner, and respectively disposed along the corresponding lengthwise side and lateral side of the combined contact region. In this embodiment, each pair of locating posts 112 is arranged in opposed relationship with respect to a corresponding diagonal line of the combined contact region. Further, as particularly shown in FIG. 4, each of the locating posts 112 is spaced from the corresponding lengthwise side or lateral side of the combined contact region with a predetermined distance. The distance may be varied according to different embodiments. It should be noted that each of the locating posts 112 is required to have a height greater than that of the IC package 2, or that of the IC package 2 and another different electrical connector (not shown) if that different electrical connector is needed to be placed onto the top surface of the IC package 2 in some particular applications of the present invention.

Figure 4:
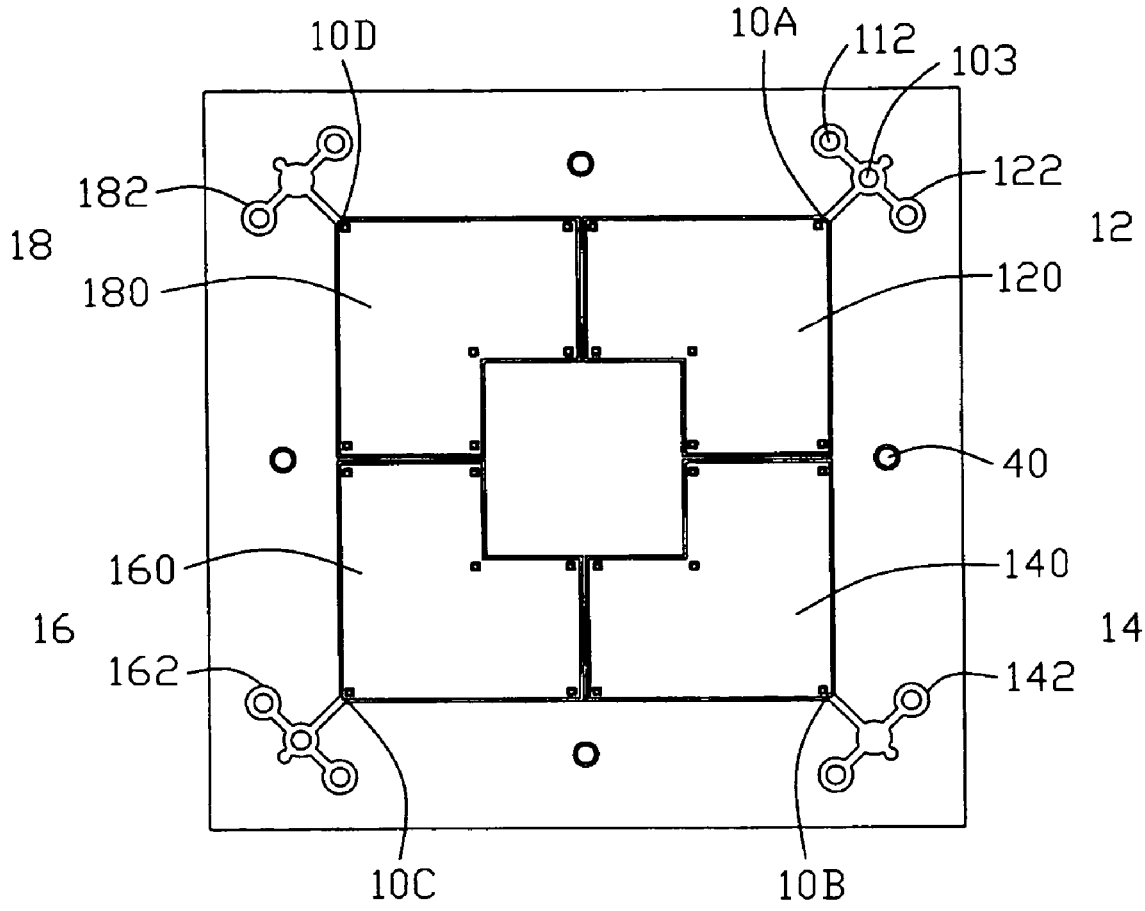
FIG. 4 is a plan view of the LGA socket connector of FIG. 2.

As particularly shown in FIG. 4, the diagonally-disposed location members 122 and 162 further include a pair of alignment apertures 103 for corresponding to alignment holes 20 formed in the IC package 2. The alignment apertures 103 are disposed along one of diagonal lines of the rectangular contact region. In this embodiment, each of the alignment apertures 103 is arranged between two locating holes 102 of each location members. As such, when the alignment holes 20 of the IC package 2 and the alignment apertures 103 of the location members 122 and 162 are correctly matched or aligned with each other, it can be ensured that the IC package 2 is correctly mounted onto the LGA socket connector 10.

Figure 5:
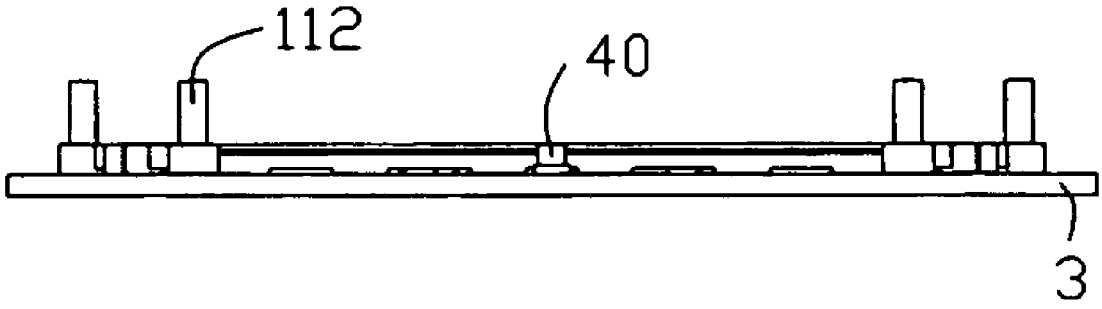
FIG. 5 is a side view of the LGA socket connector of FIG. 2.

Referring to FIGS. 3 to 5, in this embodiment, four separate supporting tabs 40, with its height slightly less than the locating posts 112, are provided to be soldered onto the printed circuit board 3, and disposed along the respective lengthwise sides and lateral sides of the combined contact region so as to support the IC package 2 when the IC package 2 are placed onto the LGA socket connector 10. However, in other embodiments, any suitable numbers of supporting tabs 40 are employed to support the IC package 2 placed on the LGA socket connector 10.

Figure 2:
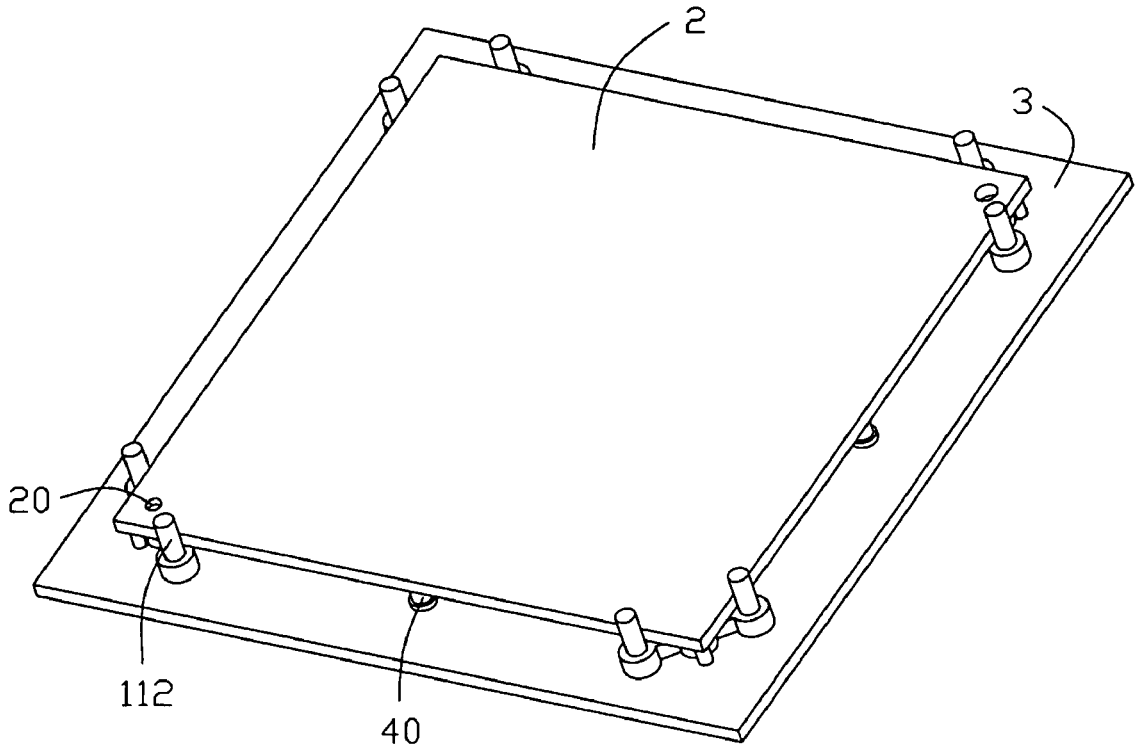
FIG. 2 is an assembled, perspective view of the LGA socket connector of FIG. 1, with an IC package received therein.

Referring to FIGS. 1 and 2, in assembly, the LGA connector sections 12, 14, 16 and 18 with no locating posts 112 are in sequence soldered onto the printed circuit board 3 such that the separate LGA connector sections 12, 14, 16 and 18 are combined to form a complete rectangular LGA socket connector 10. That is, the respective location members 122, 142, 162 and 182 and the corresponding contact segments 120, 140, 160 and 180 are simultaneously soldered onto the printed circuit board 3, due to the integral connection between the location members 122, 142, 162 and 182 and the corresponding contact segments 120, 140, 160 and 180. Four supporting tabs 40 are disposed along the respective lengthwise sides and lateral sides of the combined contact region, and also soldered onto the printed circuit board 3 so as to support the IC package 2, to be placed onto the printed circuit board 3. The IC package 2 is placed onto the LGA socket connector 20 in a manner that the alignment holes 20 of the IC package 2 align with the corresponding alignment apertures 103 formed on the location members 142 and 182. The locating posts 112 are then inserted into the respective locating holes 102 of the location members 122, 142, 162 and 182 so as to commonly receive and hold the IC package 2 in position.

Figure 7:
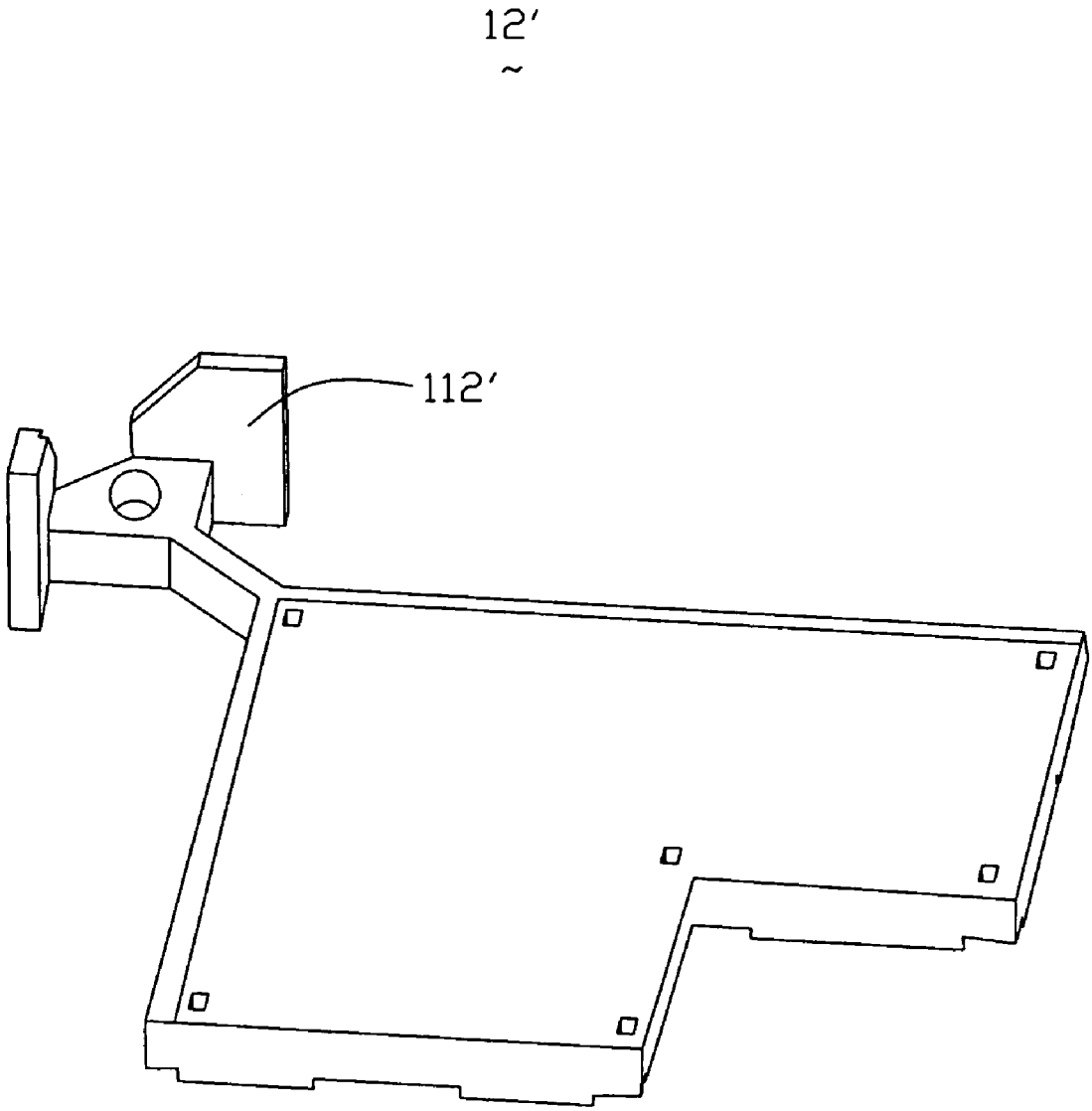
FIG. 7 is a perspective view of a LGA connector section of a LGA socket connector according to a second embodiment of the present invention.

Referring to FIG. 7, an LGA connector section 12', being part of a second LGA socket connector, is shown according to the second embodiment of the present invention. This LGA connector section 12' is similar to the LGA connector section 12 of the first embodiment, except that the shape of the location member 112' is different from that of the location member 112. That is, the location member 112' includes a pair of locating elements 112' each shaped as a wall extending along a lengthwise side or a lateral side of the corner of the LGA connector section 12'. The locating wall 112' is configured to have a sufficient width and height thereof so as to hold the IC package in position around the corner of the second LGA socket connector.

Thus, from the above description, it can be seen that the locating elements may have any suitable shape or configuration other than the locating posts 112 of the first embodiment or the locating walls 112' of the second embodiment, as long as these locating elements are configured to hold the IC package in position around each corner of the first or second LGA socket connector.

Figure 8:
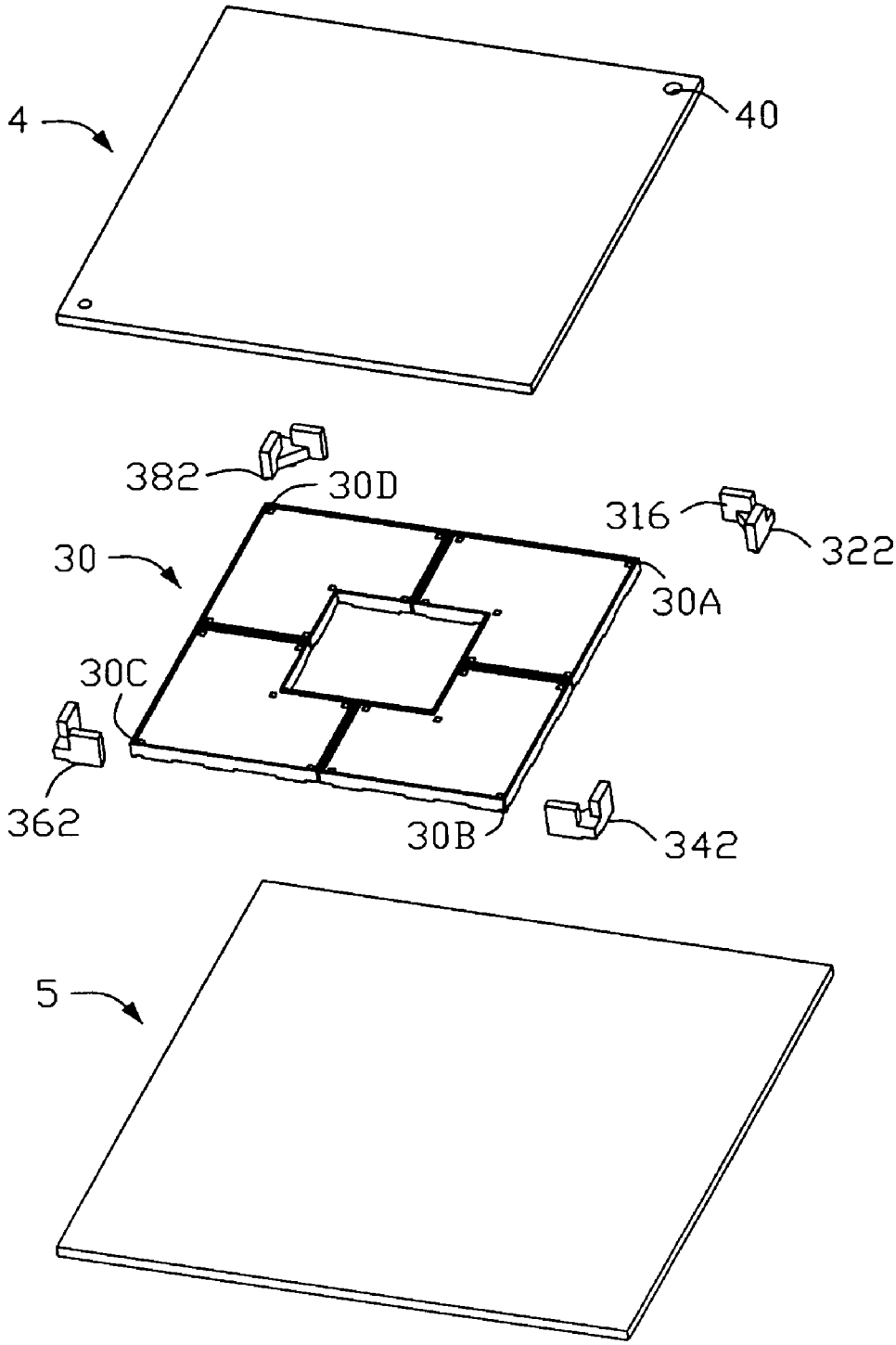
FIG. 8 is an exploded, perspective view of a LGA socket connector according to a third embodiment of the present invention.
Figure 9:
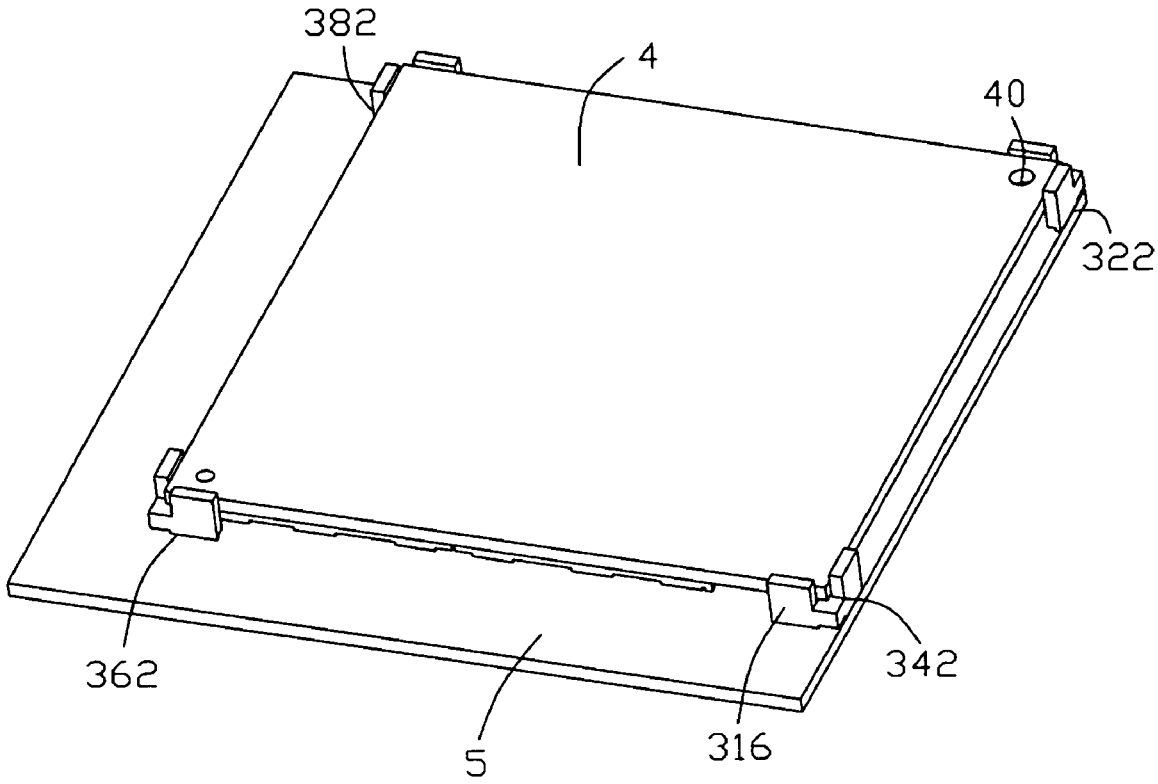
FIG. 9 is an assembled, perspective view of the LGA socket connector of FIG. 8, with an IC package received therein.
Figure 10:
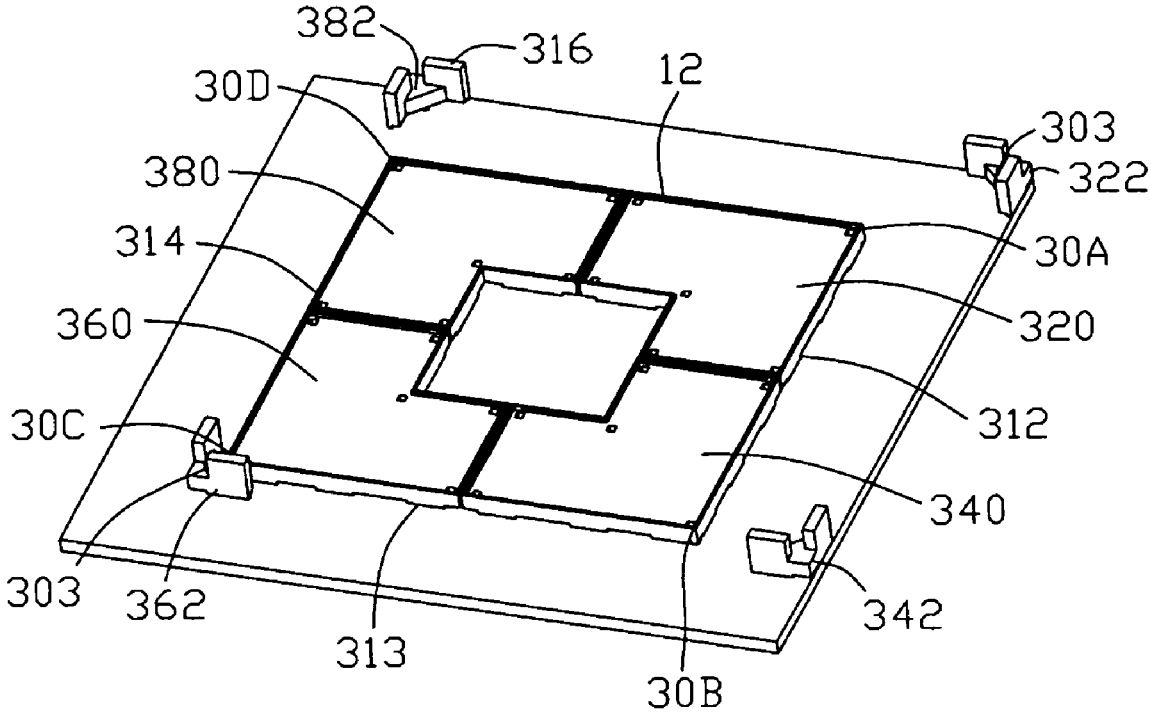
FIG. 10 is an assembled, perspective view of the LGA socket connector of FIG. 8, but with the IC package removed therefrom.

Referring to FIGS. 8 to 10, a third LGA socket connector 30 for electrically connecting an IC package 4 and a printed circuit board 5 is shown according to the first embodiment of the present invention. The third LGA socket connector 30 includes four separate contact segments 320, 340, 360 and 380, and four location members 322, 342, 362 and 382 located around respective corners 30A, 30B, 30C and 30D of the contact segments 320, 340, 360 and 380 while not physically attached to the corresponding contact segment corners 30A, 30B, 30C and 30D.

The contact segments 320, 340, 360 and 380 are combined to form a substantially rectangular socket body for engaging an array of conductive elements of the IC package 4, which is just placed on the socket body. It should be noted that the rectangular socket body might include any suitable numbers of contact segments other than four contact segments 320, 340, 360 and 380 of this embodiment, for some manufacturing considerations, such as difficulties resulting from material flow and shrinkage problems that the conventional large socket body typically encounter.

The combined socket body defines four sides including lengthwise sides 311, 313 and lateral sides 312, 314, and four corners 30A, 30B, 30C and 30D, at which the respective lengthwise sides 311, 313 and lateral sides 312, 314 intersect. The location members 322, 342, 362 and 382 are physically separated from one another, and located around the respective corners 30A, 30B, 30C and 30D of the combined socket body so as to commonly receive and hold the IC package 4 in position.

More specifically, each of the location members 322, 342, 362 and 382 includes a pair of locating elements 316, such as having a wall shape. The locating walls 316 are respectively disposed along the lengthwise sides 311, 313 and the lateral sides 312, 314 of the corresponding socket body corners 30A, 30B, 30C and 30D, such that when the IC package 4 is placed onto the LGA socket connector 30, these locating walls 316 are employed to engage an outer periphery edge of one electronic component, such as the single IC package 4; or to engage more electronic components, such as the single IC package 4 and another different electrical connector (not shown) if that different electrical connector is needed to be placed onto the top surface of the IC package 4 in some particular embodiments of the present invention. In this embodiment, each pair of locating elements 316 is arranged in opposed relationship with respect to a corresponding diagonal line of the combined socket body. The locating element 316 is spaced from the lengthwise side or lateral side of the corresponding corner of the combined socket body with a predetermined distance. The distance may be varied according to different applications. In this embodiment, since the locating elements 316 are not physically attached to the socket body, and thus movable with respect to the socket body, different distances can be obtained measuring from the locating elements 316 to the corresponding sides 311, 312, 313 and 314 of the socket body, thereby being capable of receiving various IC packages with varying sizes. It should be noted that the locating elements 316 might have any other suitable shape, such as the locating posts 312 of the first embodiment, as long as these locating elements 316 are configured to hold the IC package 4 in position around each corner 30A, 30B, 30C or 30D of the LGA socket connector 30.

In addition, as particularly shown in FIG. 10, the diagonally-disposed location members 322 and 362 further include a pair of alignment apertures 303 for corresponding to alignment holes 40 formed in the IC package 4. The alignment apertures 303 are disposed along one of the diagonal lines of the rectangular contact region, and arranged between the locating walls 316 of each location members 322 and 362. As such, when the alignment holes 40 of the IC package 4 and the alignment apertures 303 of the location members 322 and 362 are correctly matched or aligned with each other, it can be ensured that the IC package 4 is correctly mounted onto the LGA socket connector 30.

Referring to FIGS. 8 and 9, in assembly, the contact segments 320, 340, 360 and 380 are in sequence soldered onto the printed circuit board 5 such that the separate contact segments 320, 340, 360 and 380 are combined to form a complete rectangular socket body. The locating members 322, 342, 362 and 382 are disposed along the respective sides 311, 312, 313 and 314 around the corners 30A, 30B, 30C and 30D of the socket body with predetermined distances from the locating walls 316 to the corresponding lengthwise sides 311, 313 or lateral sides 312, 314 of the socket body such that the region surrounded by the locating walls 316 is adapted for receiving and holding the IC package 4 in position. These disposed locating members 322, 342, 362 and 382 are further soldered to the printed circuit board 5. The IC package 4 is then placed onto the LGA socket connector 30 in a manner that the alignment holes 40 of the IC package 4 align with the corresponding alignment apertures 303 formed on the location members 322, 342, 362 and 382, thereby assuring the correct mounting of the IC package 4. As such, with the location members 322, 342, 362 and 382 pre-located around the respective body corners, the IC package 4 is thus held in position.

In this embodiment, since the distances between the respective locating walls 316 and the corresponding sides 311, 312, 313 and 314 of the socket body is adjusted by moving the locating walls 316 with respect to the socket body, the region defined therebetween is capable of receiving different IC package with varying sizes. In other words, such a LGA socket connector 30 with separate location members 322, 342, 362 and 382 can be applicable for various IC packages, not merely limited to one type of IC package. This will certainly cost down the manufacturing of electronic components, which involves the application of the LGA socket connector 30.

From the above descriptions, the present LGA connectors 10, 30 are designed to be structurally versatile compared with the prior art, and will certainly occupy less room on the supporting printed circuit board. Further, there are no difficulties, including the material flow and shrinkage problems, existing for manufacturing the present LGA socket connectors 10, 30, due to having several separate pieces, such as contact segments and location members, combined to form the present LGA socket connectors 10, 30.

While the present invention has been described with reference to preferred embodiments, the description of the invention is illustrative and is not to be construed as limiting the invention. Various of modifications to the present invention can be made to preferred embodiments by those skilled in the art without departing from the true spirit and scope of the invention as defined by the appended claims.

What is claimed is:

1. A land grid array (LGA) socket connector comprising:

a plurality of contact segments for engaging respective connection sections of an IC package, the contact segments being combined to form a substantially rectangular contact region, the rectangular contact region defining corners; and location members being physically separated from one another, the location members being disposed around the respective corners to receive and hold the IC package in position; and there are four separate contact segments, each contact segment defining one corresponding corner; and said location members are attached to the respective corners of the contact segments; and each of the location members includes two locating elements, said two locating elements respectively disposed along a lengthwise side and a lateral side of each corner; and the location members include a pair of a locating post and a pair of alignment holes disposed along a diagonal line of the rectangular contact region, and each of the alignment holes being arranged between said two locating holes.

2. The LGA socket connector as recited in claim 1, wherein said two locating elements are spaced from the corresponding lengthwise side and lateral side of the corner of the contact segment.

3. The LGA socket connector as recited in claim 1, wherein said two locating elements are arranged in opposed relationship with respect to a diagonal line of the rectangular contact region.

4. The LGA socket connector as recited in claim 3, wherein said locating element includes a locating wall.

5. A land grid array (LGA) socket connector comprising:

a generally rectangular socket body, the socket body comprising a plurality of contact segments for engaging respective connection sections of an IC package, the socket body defining two lengthwise sides and two lateral sides, and corners at which the respective lengthwise sides and lateral sides intersect; and locating elements disposed along the respective sides around said corners of the socket body, each of the locating elements being physically separated from one another, said locating elements configured to engage an outer periphery edge of the IC package so as to hold the IC package in position; and locating elements form a unitary location member, the attached to each corner of the contact segments; and every two location members form a unitary location member, the location member is attached to each corner of the contact segments; and the location members include a pair of a locating post and a pair of alignment holes disposed along one of two diagonal lines of the rectangular contact region, each of the alignment holes being arranged between said two locating elements.

6. The LGA socket connector as recited in claim 5, wherein said location member is adapted to be soldered onto a printed circuit board.

7. The LGA socket connector as recited in claim 5, wherein said two locating elements are arranged in opposed relationship with respect to a diagonal line of the rectangular socket body.

8. The LGA socket connector as recited in claim 7, wherein said locating element includes a locating wall.

9. An LGA socket connector assembly comprising a printed circuit board; a socket connector located on the printed circuit board and divided into several areas with dividers therebetween; and wherein a plurality of location members are equipped with the areas, respectively, while also commonly and cooperatively hold an electronic package upon the socket connector; and the location members are unitarily formed with the socket connector; each of the location members includes two locating elements; every two locating members is attached to each corner of the divided areas; and the location member is adapted to be soldered onto a printed circuit board; and the location members include a pair of a locating post and a pair of alignment holes disposed along one of two diagonal lines of the rectangular contact region, each of the alignment holes being arranged between said two locating elements.

10. The LGA socket connector assembly as claimed in claim 9, wherein said location members are integrally formed with the socket connector.

* * * * *